US007342191B2

(12) United States Patent
Yang et al.

(10) Patent No.: US 7,342,191 B2
(45) Date of Patent: Mar. 11, 2008

(54) BUTTON ASSEMBLY ON COMPUTER PANEL

(75) Inventors: Chieh Yang, Shenzhen (CN); Chen-Lu Fan, Shenzhen (CN); Li-Ping Chen, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/308,957

(22) Filed: May 29, 2006

(65) Prior Publication Data

US 2007/0221485 A1 Sep. 27, 2007

(30) Foreign Application Priority Data

Mar. 23, 2006 (CN) ..... 2006 2 0056986

(51) Int. Cl.
*H01H 9/02* (2006.01)

(52) U.S. Cl. ..... 200/296

(58) Field of Classification Search ..... 200/310–317, 200/296; 341/22; 345/168–173
See application file for complete search history.

(56) References Cited

U.S. PATENT DOCUMENTS

| | | | | |
|---|---|---|---|---|
| 4,220,808 | A | 9/1980 | Fujita | |
| 4,288,672 | A * | 9/1981 | Puccini | 200/314 |
| 4,449,024 | A * | 5/1984 | Stracener | 200/317 |
| 4,491,692 | A * | 1/1985 | Lee | 200/314 |
| 4,772,769 | A * | 9/1988 | Shumate | 200/314 |
| 5,150,092 | A * | 9/1992 | Kolb | 200/332.2 |
| 5,343,006 | A | 8/1994 | Moffett | |
| 6,522,147 | B1 * | 2/2003 | Pickard et al. | 200/314 |
| 7,038,152 | B2 * | 5/2006 | Watanabe | 200/314 |

* cited by examiner

*Primary Examiner*—Elvin Enad
*Assistant Examiner*—M. Fishman
(74) *Attorney, Agent, or Firm*—Wei Te Chung

(57) ABSTRACT

A button assembly includes a panel (10), an indicating lamp (30) and a button member (20). The panel defines a through hole (15) with supporting collar. The button member defines a securing hole (28) corresponding to the through hole. The securing hole is aligned with the through hole with the supporting collar connecting therethrough, and the indicating lamp is positioned in the through hole.

11 Claims, 4 Drawing Sheets

BUTTON ASSEMBLY ON COMPUTER PANEL

FIELD OF THE INVENTION

The present invention relates to a button assembly, more particularly to a button assembly on a computer panel with simple configuration.

DESCRIPTION OF RELATED ART

In the conventional methods for mounting an electrical apparatus such as a pushing button switch or an indicating lamp on a supporting member such as a panel. A screw or a supporting portion formed as a part of a body of the electrical apparatus is used for securing the electrical apparatus on the supporting member.

A panel mount switch assembly for mounting a push-button actuator switch on an opening in a panel is disclosed. The switch assembly includes a switch base holder connected to a switch base. A pair of legs is connected to the base holder and positioned to protrude through the opening along opposite sides of the switch actuator. A switch plunger engages with the actuator. The legs are inserted into the opening. A lip formed on a distal end of each leg extends over the panel to prevent the legs from disengaging from the opening when a downward force is applied to the switch actuator. Once the legs are engaged with the opening, the switch plunger is attached to the switch actuator by inserting the actuator in a channel formed in the plunger, and thereby frictionally engaging the actuator with the plunger. However, in this conventional button device, the screw or the switch base holder is separately installed. The assembly process is unduly complicated and calls for additional manufacturing cost.

What is needed, therefore, is a button assembly having simplified configuration which has a stable attachment with a computer panel.

SUMMARY OF THE INVENTION

A button assembly includes a panel, an indicating lamp, and a button member. The panel defines a through hole with supporting collar. The button member defines a securing hole corresponding to the through hole. The securing hole is aligned with the through hole with the supporting collar connecting therethrough, and the indicating lamp is positioned in the through hole.

Other advantages and novel features will be drawn from the following detailed description of a preferred embodiment with attached drawings, in which:

DETAILED DESCRIPTION

Figure 1:
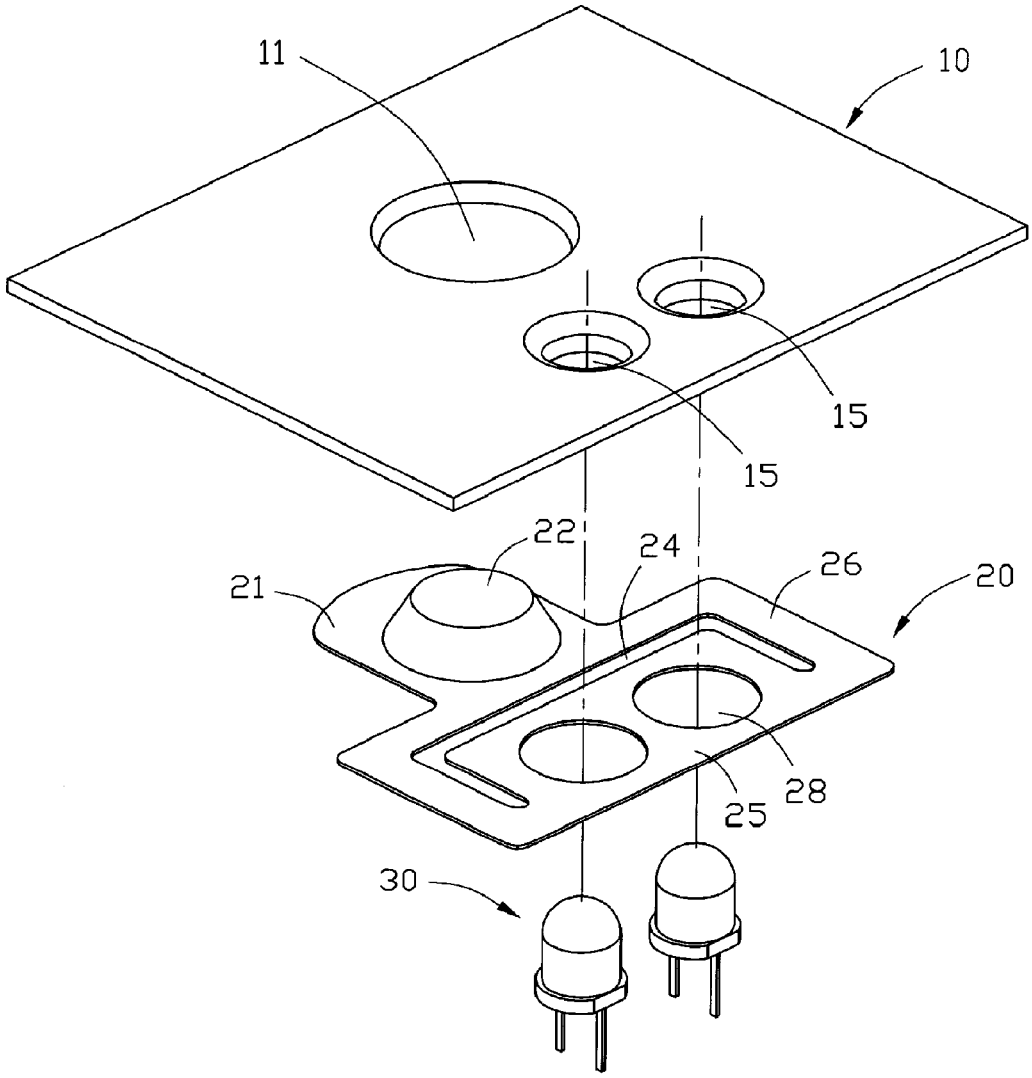
FIG. 1 is an exploded, isometric view of a button assembly on a computer panel of a preferred embodiment of the present invention, the button assembly including a button member and a pair of indicating lamps.
Figure 2:
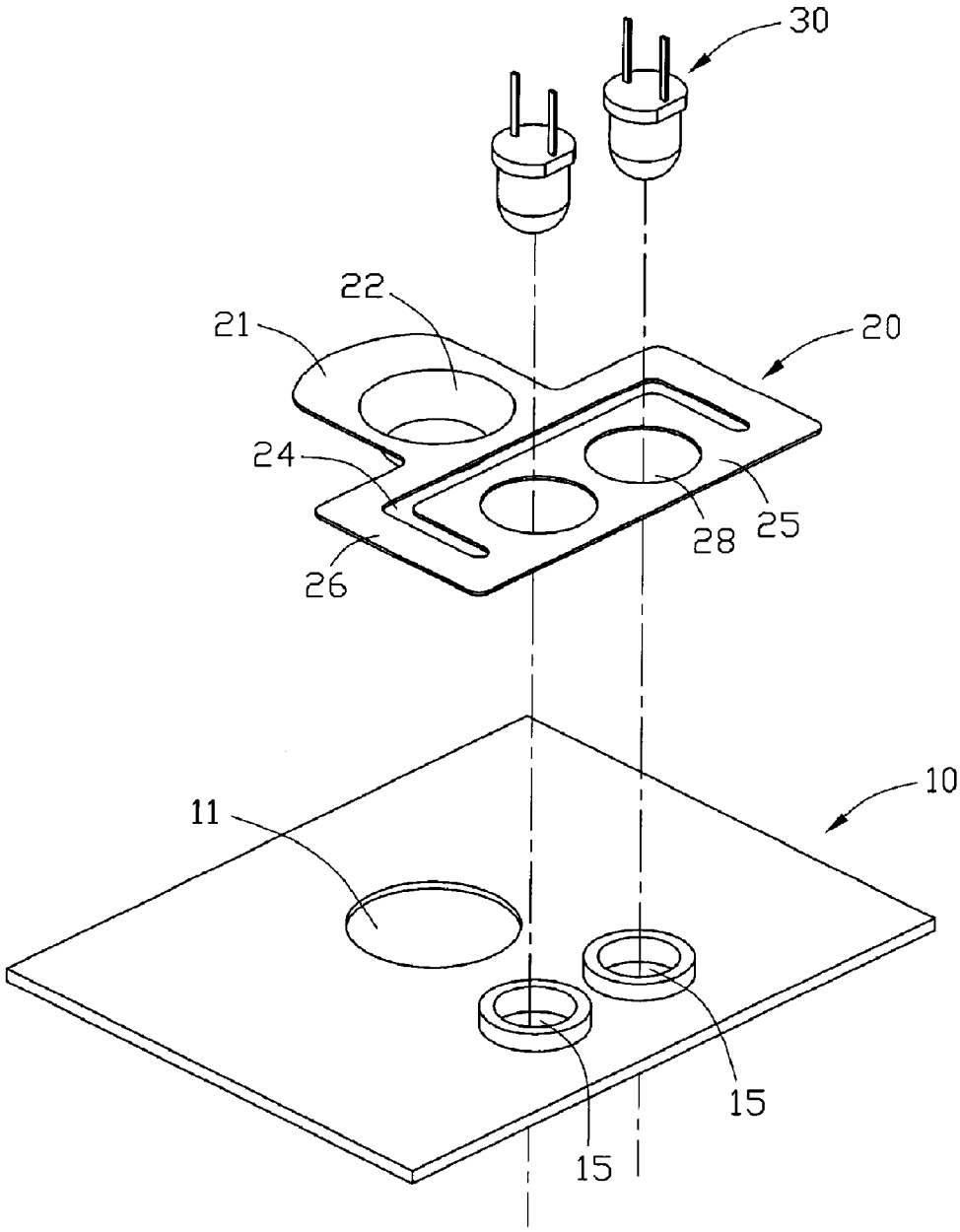
FIG. 2 is similar to FIG. 1, but shown from another aspect.

Referring to FIG. 1 and FIG. 2, a button assembly on a computer panel 10 of the preferred embodiment of the present invention includes a button member 20, and a pair of indicating lamps 30. The panel 10 defines a button opening 11. A pair of through holes with supporting collars 15 extrudes down from the panel 10 (see FIG. 2).

The button member 20 is made in a resilient clip structure. The button member 20 includes a pushing portion 21 and a securing portion 25. A columnar pushing button 22 is stamped on a central portion of the pushing portion 21 corresponding to the button opening 11 of the panel 10. A generally U-shaped slot 24 is defined between the pushing portion 21 and the securing portion 25. Two resilient portions 26 are formed on opposite sides of the securing portion 25. A pair of securing holes 28 is defined in the securing portion 25 corresponding to the through holes 15. Outer diameters of the through holes 15 and the securing holes 28 are equal.

Each indicating lamp 30 has a columniform body. Inner diameters of the through holes 15 are a little greater than a diameter of the body of the indicating lamp 30.

Referring also to FIG. 2, when assembling the button assembly, the pushing button 22 is received in the button opening 11 of the panel 10. The button member 20 is riveted to the panel 10 with the securing holes 28 aligned with the corresponding through holes 15.

Figure 3:
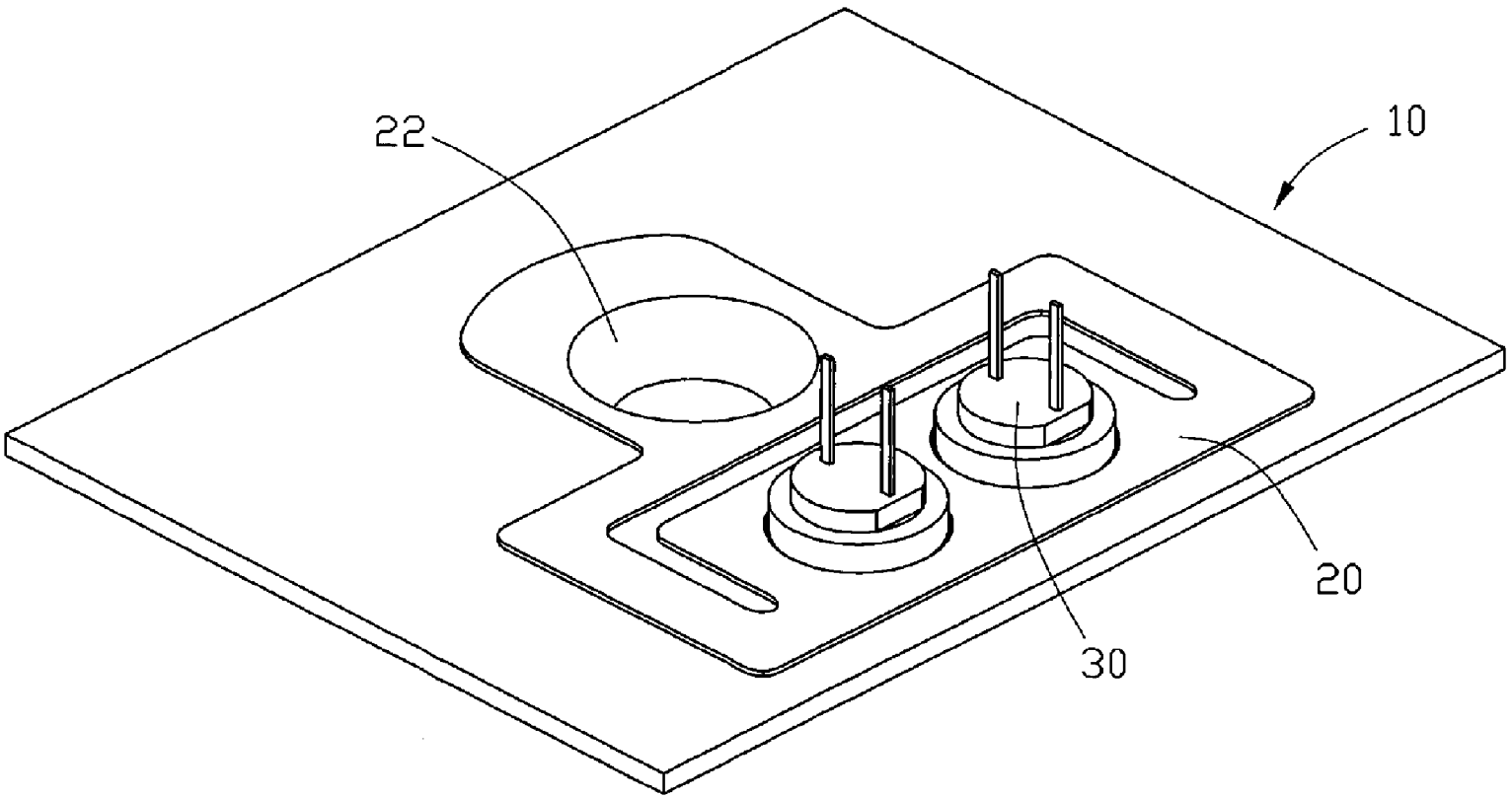
FIG. 3 is an assembled, isometric, inverted view of the button assembly of FIG. 1.
Figure 4:
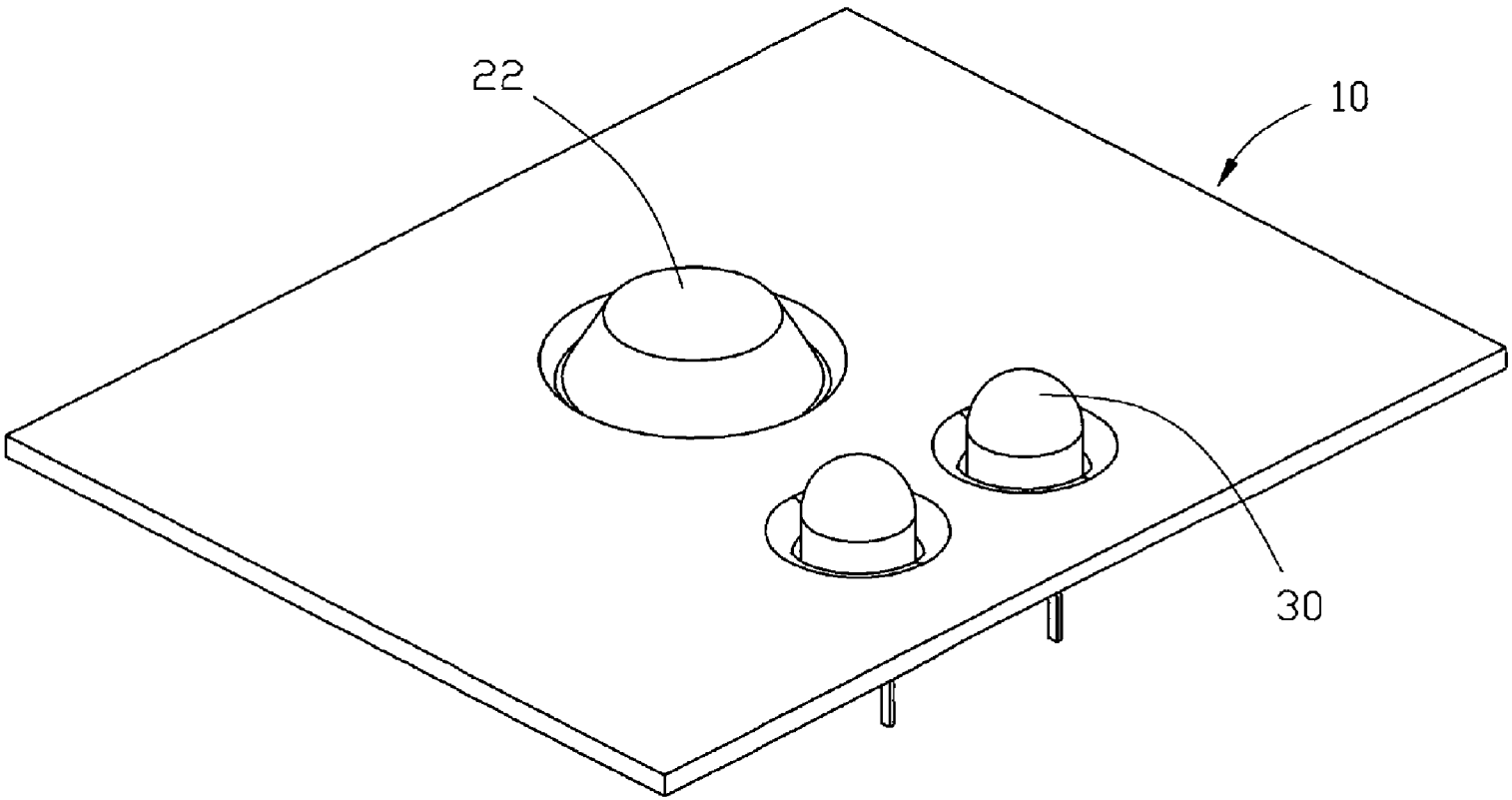
FIG. 4 is similar to FIG. 3, but not inverted.

Referring also to FIG. 3, when using the button assembly, the pushing button 22 is pushed in by a user from an outer side of the panel 10. The resilient portions 26 are deformed. The button member 20 connects to a power switch (not shown) of a computer. The computer is switched on or off by the pushing button 22 abutting against the power switch. When the pushing button 22 is released, the resilient portion 26 rebounds. Then the pushing button 22 is returned to its original position.

Riveting of the button member to the panel provides a button assembly that is simple and easy to manufacture.

It is to be understood, however, that even though numerous characteristics and advantages have been set forth in the foregoing description of a preferred embodiment, together with details of the structure and function of the preferred embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A button assembly, comprising:

a panel having a main body defining an opening, a through hole spaced from the opening, and a supporting collar extending from the main body thereof and surrounding the through hole;

an indicating lamp; and a button member attached to the panel, the button member comprising a pushing portion and a securing portion, the pushing portion having a pushing button formed thereon, the pushing button being deflectable relative to the securing portion and being located in the opening outside the through hole, the securing portion defining a securing hole corresponding to the through hole wherein the securing hole is aligned with the through hole with the supporting collar connecting therebetween, and the indicating lamp is positioned in the through hole.

2. The button assembly as described in claim 1, a slot is defined between the pushing portion and the securing portion.

3. The button assembly as described in claim 2, wherein the slot is U-shaped.

4. The button assembly as described in claim 1, wherein an outer diameter of the supporting collar of the through hole is substantially equal to that of the securing hole.

5. The button assembly as described in claim 4, wherein the indicating lamp has a columniform body, and an inner diameter of the through hole is slightly greater than a diameter of the body of the indicating lamp.

6. A computer button assembly, comprising:

a panel defining a through hole and a button opening therein;

an indicating lamp received in the through hole; and a button member comprising a securing portion attached to the through hole, and a pushing button formed on the button member accessible through the button opening, a slot defined between the pushing button and the securing portion.

7. The button assembly as described in claim 6, wherein the button member is made in a clip structure.

8. The button assembly as described in claim 6, wherein a securing hole is defined in the securing portion corresponding to the through hole.

9. The button assembly as described in claim 8, wherein a supporting collar is formed along an edge of the through hole for connecting the button member through the securing hole.

10. The button assembly as described in claim 9, wherein the indicating lamp has a columniform body, and an inner diameter of the through hole is slightly greater than a diameter of the body of the indicating lamp.

11. The button assembly as described in claim 6, wherein the slot is U-shaped.

* * * * *